US009903594B2

(12) United States Patent
Klein et al.

(10) Patent No.: US 9,903,594 B2
(45) Date of Patent: Feb. 27, 2018

(54) COOKING ARRANGEMENT

(75) Inventors: Gerhard Klein, Neusitz (DE); Alwin Neukamm, Wilhermsdorf (DE); Bjorn Leyh, Blaufelden (DE); Eva Holzgreve, Pordenone (IT)

(73) Assignee: Electrolux Home Products Corporation N.V., Brussels (BE)

( * ) Notice: Subject to any disclaimer, the term of this patent is extended or adjusted under 35 U.S.C. 154(b) by 657 days.

(21) Appl. No.: 13/577,738

(22) PCT Filed: Mar. 29, 2011

(86) PCT No.: PCT/EP2011/001566
§ 371 (c)(1),
(2), (4) Date: Aug. 8, 2012

(87) PCT Pub. No.: WO2011/120671
PCT Pub. Date: Oct. 6, 2011

(65) Prior Publication Data

US 2013/0008885 A1 Jan. 10, 2013

(30) Foreign Application Priority Data

Mar. 31, 2010 (EP) ..... 10003525

(51) Int. Cl.
*F24C 15/10* (2006.01)

(52) U.S. Cl.
CPC ..... *F24C 15/108* (2013.01)

(58) Field of Classification Search
CPC ..... F24C 15/10; F16B 5/06; H05B 3/74
(Continued)

(56) References Cited

U.S. PATENT DOCUMENTS 2,992,315 A * 7/1961 McDonnold ..... 219/453.15
3,838,249 A * 9/1974 Detterbeck ..... F24C 7/082 219/455.11

(Continued)

FOREIGN PATENT DOCUMENTS

CN 1892116 A 1/2007
DE 2106747 8/1972

(Continued)

OTHER PUBLICATIONS

International Search Report for PCT/EP2011/001566, dated Jul. 19, 2011, 3 pages.

*Primary Examiner* — David Angwin
*Assistant Examiner* — Jimmy Chou
(74) *Attorney, Agent, or Firm* — Pearne & Gordon LLP

(57) ABSTRACT

The invention relates to a cooking arrangement (1) comprising a cooking hob (2) which is arranged on a worktop (3), wherein the cooking hob (2) is supported on the worktop (3) by means of a carrier frame (4), wherein the cooking hob (2) has a vertical height (H) and a bottom member (6) with a bottom surface which is directed vertically downwards and wherein the worktop (3) has a top surface (7) which is directed vertically upwards. To allow an arrangement of the cooking hob (2) without machining a cutout into the worktop (3) the invention proposes that the carrier frame (4) is designed to support the cooking hob (2) in such a way that the bottom surface of the bottom member (6) is positioned in a vertical height equal or above (x) the vertical height of the top surface (7) of the worktop (3).

18 Claims, 6 Drawing Sheets

Figure 1:
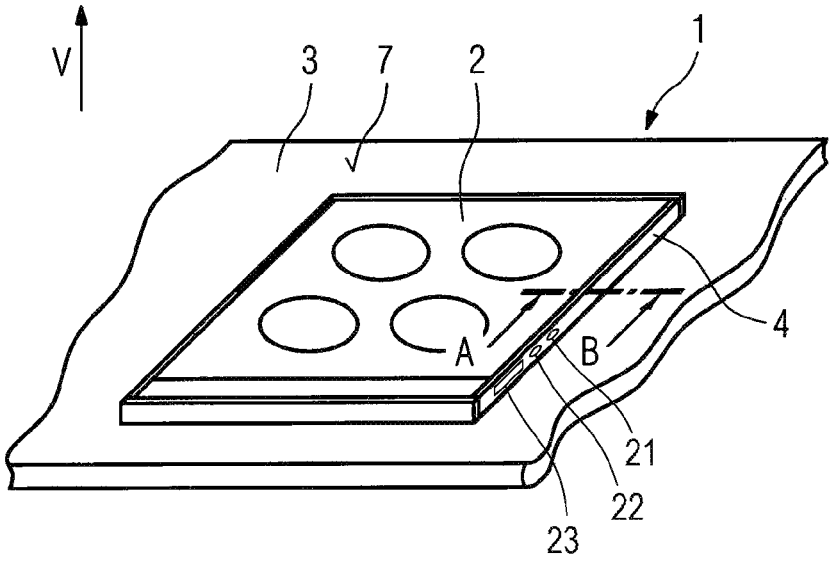

(58) Field of Classification Search
USPC ..... 99/422, 393, 421 R; 126/1 R, 217, 126/214 A, 214 C; 219/460, 457, 463, 219/464.467
See application file for complete search history.

(56) References Cited

U.S. PATENT DOCUMENTS

| | | | | | |
|---|---|---|---|---|---|
| 4,766,290 | A * | 8/1988 | Schreder | F24C 15/104 | 219/456.1 |
| 5,653,550 | A * | 8/1997 | Mutz | E03C 1/33 | 4/633 |
| 5,844,206 | A * | 12/1998 | Steiner | A47B 77/08 | 219/452.12 |
| 6,050,176 | A * | 4/2000 | Schultheis | H05B 3/74 | 126/39 K |
| 6,330,991 | B1 * | 12/2001 | Boe | 248/200 | |
| 6,455,819 | B1 * | 9/2002 | Pohl | F24C 15/102 | 219/452.12 |
| 6,562,468 | B2 * | 5/2003 | Wegert et al. | 428/447 | |
| 8,026,462 | B2 * | 9/2011 | Arnold | F24C 15/10 | 219/451.1 |
| 8,080,768 | B2 * | 12/2011 | Adam | A47B 77/08 | 126/211 |
| 2006/0144388 | A1 * | 7/2006 | Hosoi et al. | 126/214 A | |
| 2010/0175682 | A1 * | 7/2010 | Erikson | A47J 37/067 | 126/25 R |

FOREIGN PATENT DOCUMENTS

| | | | | |
|---|---|---|---|---|
| DE | 2166827 | | 7/1981 | |
| DE | 19856538 | | 5/2000 | |
| DE | 20319629 | | 3/2004 | |
| DE | 202006000248 | | 3/2006 | |
| EP | 1515092 | | 3/2005 | |
| EP | 2099257 | A2 * | 9/2009 | H05B 3/74 |
| EP | 2110608 | | 10/2009 | |
| EP | 2144009 | A1 * | 1/2010 | F24C 15/108 |
| GB | 2241322 | A * | 8/1991 | |
| JP | 2007010226 | A * | 1/2007 | |
| JP | 2008-32352 | A | 2/2008 | |

* cited by examiner

COOKING ARRANGEMENT

The invention relates to a cooking arrangement comprising a cooking hob which is arranged on a worktop, wherein the cooking hob is supported on the worktop by means of a carrier frame, wherein the cooking hob has a vertical height and a bottom member with a bottom surface which is directed vertically downwards and wherein the worktop has a top surface which is directed vertically upwards.

Cooking arrangements of this kind are well-known in the art. DE 21 66 827 C3 shows such a solution. A cutout is machined into a worktop of a kitchen. The size of the cutout corresponds to the size of the bottom part of the cooking hob which has to be mounted into the cutout of the worktop. A frame element is used which holds the cooking hob and is itself connected to the work-top at the edge of the cutout. Consequently, the size of the cutout must be machined according to the size of the cooking hob which has to be mounted into the worktop.

Similar solutions are known from EP 2 110 608 A1 and from DE 20 2006 000 248 U1.

Thus, the worktop is serving as the containing element for the cooking hob. For arranging of the cooking hub in the worktop a respective cutout must be machined. Due to the size of the cooking hob, which can vary in a wide range, it is not possible to define any standard dimension for the cutout in the worktop. If another (new) cooking hob has to be mounted into an existing worktop it is thus necessary to re-machine the cutout to adapt it to the new required size. If in fact the new cooking hob requires only a smaller cutout it is normally necessary to purchase a new worktop so that the cooking hob reasonable fits into the worktop. This makes the mounting of a (new) cooking hob expensive.

As the cooking hob is firmly mounted in a worktop it is also not possible to use the cooking hob at another location without significant expenditure. So the use of the cooking hob is quite inflexible.

It is also observed that the cooking hob has a certain vertical height, so that the bottom part of the cooking hob extends more of less far below the working top. This makes it sometimes problematic to arrange devices (like refrigerators or dish washers) or drawers below the cooking hob. So, sometimes space in the kitchen cannot be used most efficiently.

Therefore, it is an object of the invention to propose a cooking arrangement of the kind mentioned above which overcomes the explained drawbacks. Thus, it should be easier to mount another (a new) cooking hob in an existing worktop without the necessity to re-work a cutout in the worktop or to furnish a new worktop. Furthermore, also the mounting of a new cooking hob in a new worktop should become less cost-expensive. The use of the cooking hob should become more flexible. Finally, is should become possible to use the space in the kitchen in an optimized way, especially below the cooking hob.

The solution of this object is characterized in that the carrier frame is designed to support the cooking hob in such a way that the bottom surface of the cooking hob is positioned in a vertical height equal or above the vertical height of the top surface of the worktop.

Preferably, the carrier frame has a first bearing area for being arranged on the top surface of the worktop and has a second bearing surface for the cooking hob being arranged on it.

The carrier frame can have a substantial rectangular form. It can consist of four rails, wherein two rails are connected to another. The connection of two rails can be established and/or reinforced by means of a corner connection.

The carrier frame can consist of parts machined from a profiled element. The profiled element can have at least on hollow section. The profiled element can be made by a casting process or by a mechanical process.

The carrier frame can further comprise a base body which is covered at its outer side by a panel. The panel can be affixed to the base body by means of a snap connection. Also, it is possible that the panel is affixed to the base body by means of an adhesive.

The carrier frame and/or its parts are preferably made of wood, steel and/or aluminium.

Furthermore, it is possible that a switch element, an illumination element and/or a display element is integrated into the carrier frame.

Connection means can be arranged between the cooking hob and the carrier frame, wherein the carrier frame has preferably a form fit connection element for engagement of the connection means.

The carrier frame, especially its base body, can have at least one groove running in a longitudinal direction of the carrier frame, wherein a sealing element is arranged in the groove for sealing the carrier frame against the cooking hob and/or the worktop.

By the suggested arrangement it is now possible to go completely without the machining of a cutout into the worktop. That makes the mounting of the cooking arrangement significantly more economical.

Also, if already a cutout exists in the worktop it is not necessary to re-machine its size when a new cooking hob is to be mounted. Even if the existing cutout is smaller than the size which would be now required the cooking hob can be mounted above the existing cutout.

By the proposed carrier frame it is possible to lift the cooking hob in such a way that the space below the cooking hob remains sufficient to arrange a drawer or a kitchen device (e. g. a dish washer or a refrigerator) without space problems. The lifting is done in such a way that the bottom part of the cooking hob does not extend downwards below the worktop.

By the simple design of the carrier frame, especially when profiled material is used for the frame, it is possible without any problems to arrange a cooking hob on a worktop in a very flexible and cost-efficient manner. The frame can be produced in the desired size very easy to fit to the size of the cooking hob. So, if a cutout is already existing in the worktop which has to be covered by a (new) cooking hob it is possible to select the carrier frame to cover different cutout sizes and to carry cooking hobs of different sizes.

Furthermore, different outer shapes of the cooking hobs and the cutouts respectively can be realized.

Due to the simple design of the carrier frame it is also possible to produce the frame in different heights. The height can be varied in such a manner that according to the desired device below the cooking hob (drawer, refrigerator, dish washer) the required space exists for the device. It is of course also possible to lift the cooking hob by the carrier frame just to that extend that no cutout is required to mount the cooking hob onto the worktop. So, the cooking hob becomes quite mobile and can be used at different locations.

When panels are used to cover the carrier frame or also when the carrier frame itself is designed accordingly it is possible in a cost-efficient way to adapt the design of the carrier frame to the design of the kitchen or to other surrounding elements.

Thus, the carrier frame can consist of a base body which can be made from a solid material (made by casting or mechanical machining) or can have a hollow section. Extruded metal profiles (solid or hollow ones) can also be employed. The base body can consist of wood, steel aluminium or similar material. It is also possible to paint the base body or to attach special design part at it. Those design parts can also consist of different materials like glass, metal (also painted metal), stainless steel or the like.

It is also possible to attach at the carrier frame storage surfaces, e. g. for cookware. Those surfaces can also be integrated into the design of the carrier frame. Those storage surfaces can be permanently fixed with the carrier frame or can be designed as detachable parts.

The carrier frame can be printed, e. g. with a company logo or with symbols.

Also, it is possible to integrate additional functions into the carrier frame, like touch switches, illumination elements, displays or the like.

If necessary the carrier frame can also be equipped with an outlet for a cable or with reception elements for mounting springs of the cooking hob.

The carrier frame can be simply arranged without any fixation onto the worktop or another support. On the other hand, the carrier frame can also be affixed with a worktop by means of screws or adhesives or the like. Also a special fixation strip can be used for affixing the carrier frame to the worktop.

For sealing the carrier frame to the worktop a sealing strip can be arranged in the region of the contact surfaces between the carrier frame and the worktop as well as between the carrier frame and the cooking hob. For the reception of the sealing strip a groove can be machined into the carrier frame or its parts.

In the drawings embodiments of the invention are depicted.

Figure 2:
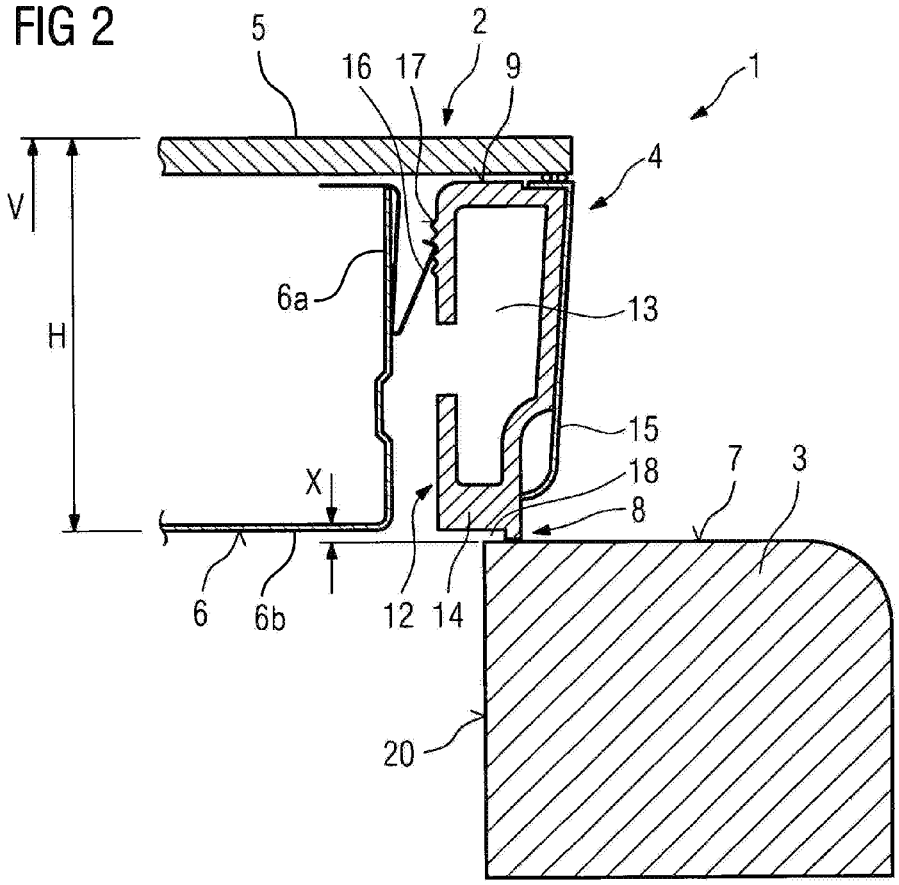
Figure 3:
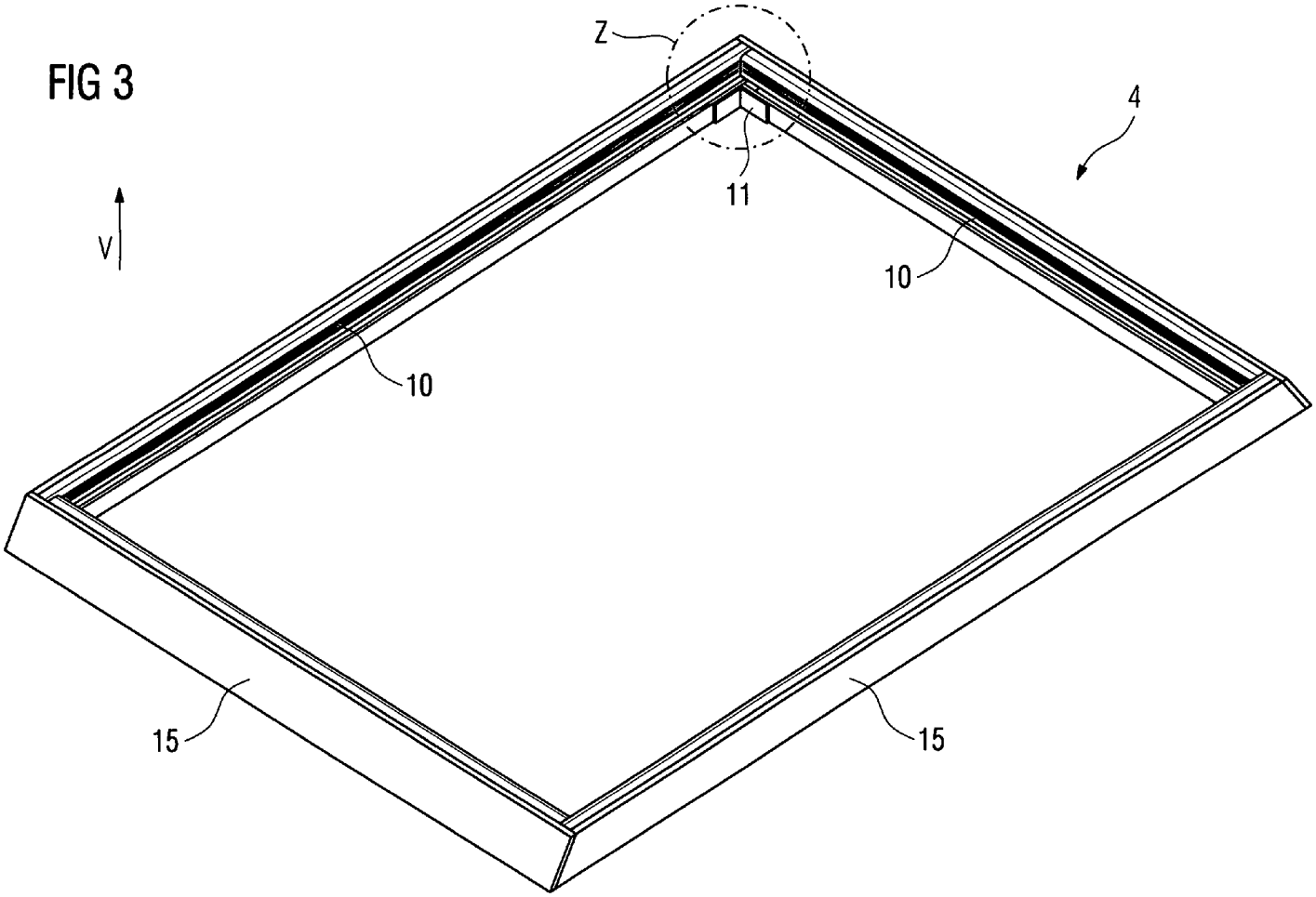
Figure 4:
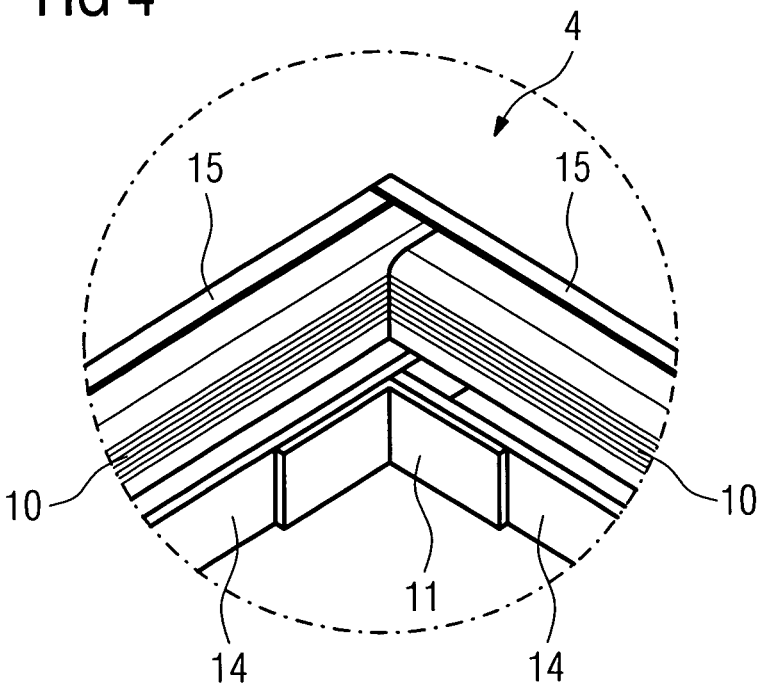
Figure 5:
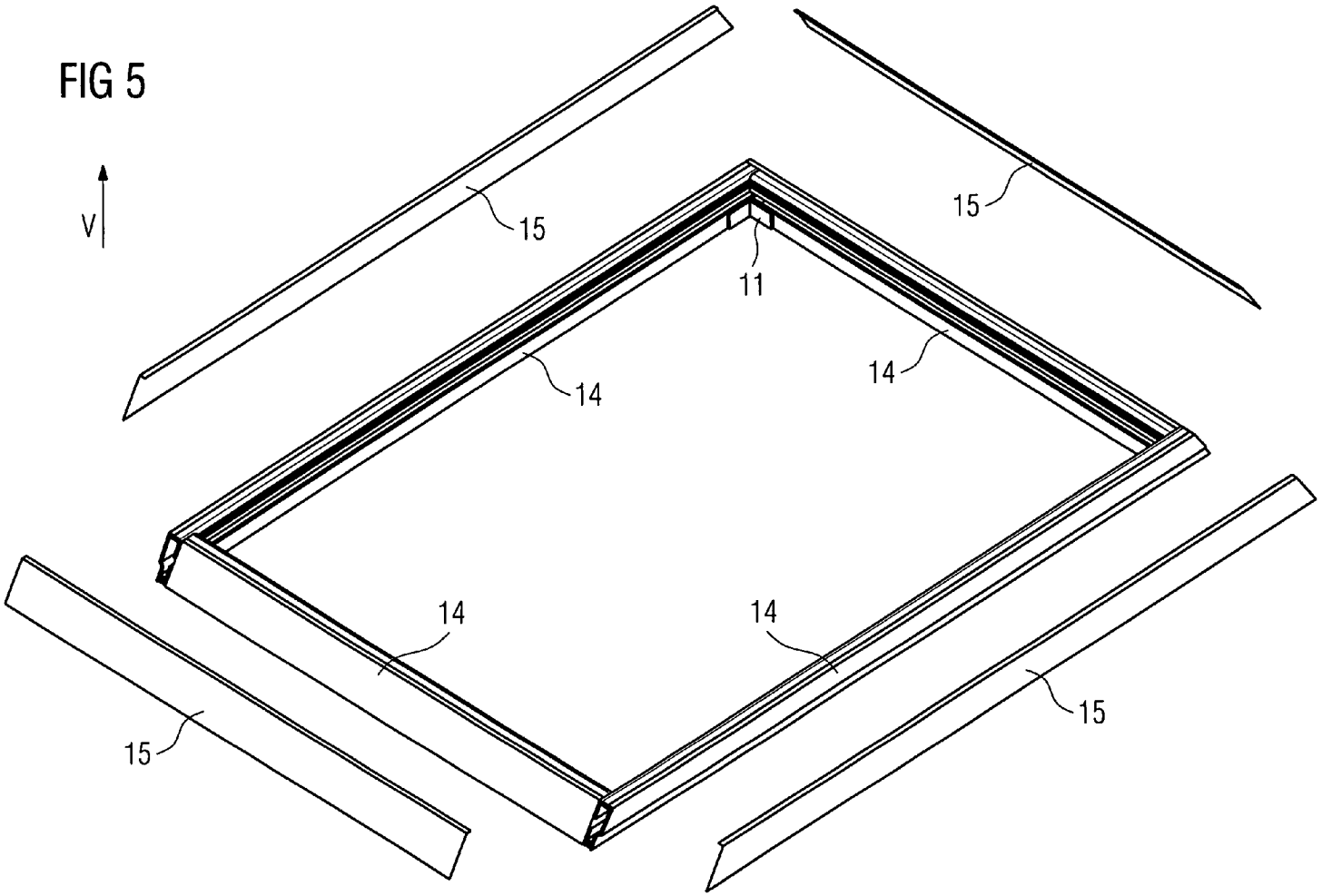
Figure 6:
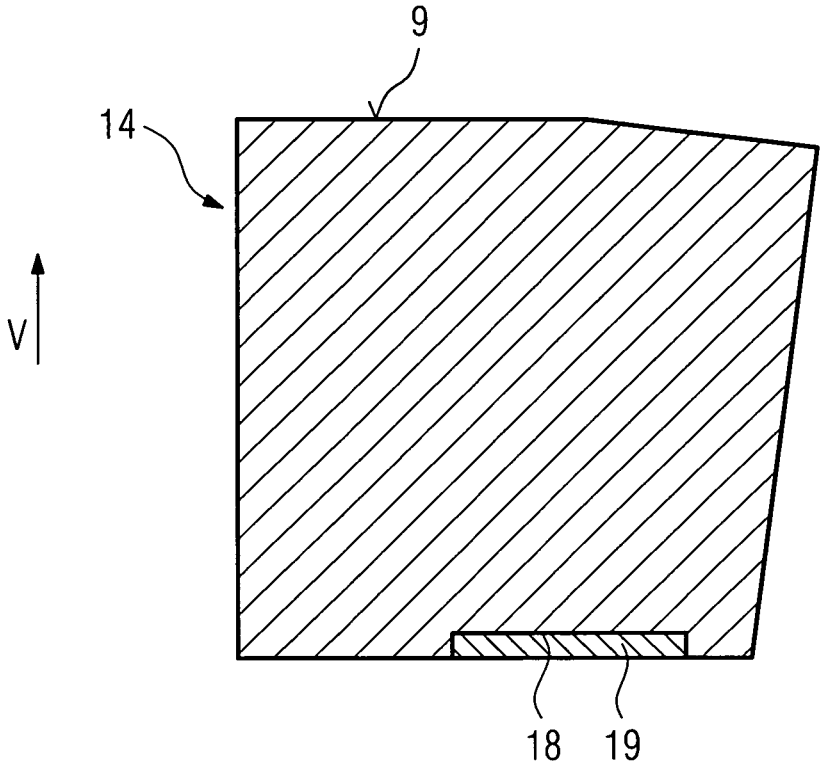

FIG. 1 shows a perspective view of a part of a worktop of a domestic kitchen on which a cooking hob is mounted by means of a carrier frame, FIG. 2 shows the cross section A-B according to FIG. 1 through the worktop, the cooking hob and the carrier frame, FIG. 3 shows a perspective view of the carrier frame according to one possible embodiment of the invention, FIG. 4 shows the detail "Z" according to FIG. 3, FIG. 5 shows a perspective explosion view of the carrier frame and FIG. 6 shows a cross section A-B according to FIG. 1 through the carrier frame according to an alternative embodiment of the invention.

In FIG. 1 a cooking arrangement 1 is shown which consists of a cooking hob 2 (with a ceramic stove top) which is affixed on a worktop 3 of a kitchen. For the fixation of the cooking hob 2 on the worktop 3 a carrier frame 4 is employed. The carrier frame 4 carries the cooking hob 2 and is itself arranged on the top surface 7 of the worktop 3. It is also possible to integrate functional elements into the carrier frame 4 like a touch switch 21, an illumination element 22, a display 23 or the like.

Details of this arrangement are depicted in FIG. 2. As can be seen here, the cooking hob 2 has a top panel member 5 and a bottom member 6. The bottom member 6 comprises an upper portion 6*a* that extends in a direction substantially vertically downward from the top panel member 5 and a lower portion 6*b* that extends horizontally inward from the upper portion 6*a*. The lower portion 6*b* is vertically spaced from the top panel member 5 and located directly below the top panel member 5. The lower portion 6*b* has a lower surface which is directed vertically downwards and an upper surface which is directed vertically upwards and directly faces the top panel member 5. The bottom member 6 is horizontally spaced inward from the carrier frame 4 such that the upper portion 6*a* of the bottom member 6 directly faces an inner peripheral side surface of the carrier frame 4. The cooking hob 2 has a certain vertical height H, measured from a top surface of the top panel member 5 to the lower surface of the lower portion 6*b*. The bottom member 6 is made of sheet metal and protects the cooking hob 2 in its lower region. Furthermore, the worktop has a top surface 7 which is arranged in a certain vertical height (vertical direction V).

In fact, the worktop 3 has already a cutout 20 which was used for the reception of a former cooking hob which had to be substituted by the depicted cooking hob 3.

As can be seen the cooking hob 3 is carried by a carrier frame 4 which has a first bearing area 8 which is resting on the top surface 7 of the worktop 3. Furthermore, the carrier frame 4 has a second bearing surface 9 on which the cooking hob 2 rests with a lateral extending part (which is a glass ceramic stove top in the present case).

The carrier frame 4 consists of rails 10 (see FIG. 3) having a base body 14, which is made from a profiled element 12 with a hollow section 13. The base body 14 is covered by a panel 15. The panel 15 can be affixed to the base body 14 by means of an adhesive.

The size of the base body 14 is selected in such a way that the bottom surface 6 of the cooking hob 3 is in the same height or higher than the top surface 7 of the worktop 3. In the case depicted in FIG. 2 there is even a certain distance x, so that the bottom surface 6 is in fact a little higher than the top surface 7. This means, that a cutout 20 in the worktop is not necessary to mount the cooking hob 2 on the worktop 3.

The cooking hob 2 is affixed to the carrier frame 4 by connection means (spring elements) 16 which are located in the carrier frame 4 in form-fitting connection elements 17.

The carrier frame 4 is put together from four rails 10 which are connected in the corners of the frame by means of corner connections 11 as can be seen in detail in FIG. 4.

In FIG. 5 is can be seen in an exploding view that each base body 14 of the carrier frame is covered by a panel 15 to get a proper outer appearance.

In FIG. 6 it is shown that the base body 14 can be equipped with a groove 18 in which a sealing element 19 (sealing strip) is arranged. So a proper sealing effect is obtained between the work-top 3 and the carrier frame 4 (and also—what is not depicted—between the carrier frame 4 and the cooking hob 2).

REFERENCE NUMERALS

1 Cooking arrangement
2 Cooking hob
3 Worktop
4 Carrier frame
5 Top panel member
6 Bottom member
6*a* Upper portion
6*b* Lower portion
7 Top surface
8 First bearing area
9 Second bearing surface
10 Rails
11 Corner connection
12 Profiled element

13 Hollow section
14 Base body
15 Panel
16 Connection means
17 Connection element
18 Groove
19 Sealing element
20 Cutout
21 touch switch
22 illumination element
23 display

The invention claimed is:

1. A cooking arrangement comprising a cooking hob which is arranged on a worktop, wherein:

the cooking hob is supported on the worktop by means of a carrier frame, the cooking hob comprises a top panel member and a bottom member, wherein the top panel member is a glass ceramic stove top and the bottom member comprises sheet metal, further wherein the bottom member comprises:

an upper portion that extends in a direction substantially vertically downward from the top panel member, and a lower portion extending horizontally inward from the upper portion that is vertically spaced from the top panel member and located directly below the top panel member, the lower portion having a lower surface which is directed vertically downwards and an upper surface which is directed vertically upwards and directly faces the top panel member, the bottom member being connected to the carrier frame with a spring element, and the bottom member being horizontally spaced inward from the carrier frame such that the upper portion of the bottom member directly faces an inner peripheral side surface of the carrier frame, the cooking hob has a vertical height and the worktop has a top surface which is directed vertically upwards, the carrier frame is designed to support the cooking hob in such a way that the entire cooking hob is positioned in a vertical height equal or above the vertical height of the top surface of the worktop, and the carrier frame comprises a profiled element having an integral, substantially C-shaped cross-section that defines a hollow section and opens toward the cooking hob.

2. The cooking arrangement according to claim 1, characterized in that the carrier frame has a substantial rectangular form.

3. The cooking arrangement according to claim 2, characterized in that the carrier frame consists of four rails, wherein two rails are connected to another.

4. The cooking arrangement according to claim 3, characterized in that the connection of two rails is established or reinforced by means of a corner connection.

5. The cooking arrangement according to claim 1, characterized in that the profiled element is made by a casting process or by a mechanical process.

6. The cooking arrangement according to claim 1, characterized in that the carrier frame comprises a base body which is covered at its outer side by a panel.

7. The cooking arrangement according to claim 6, characterized in that the panel is affixed to the base body by means of a snap connection.

8. The cooking arrangement according to claim 6, characterized in that the panel is affixed to the base body by means of an adhesive.

9. The cooking arrangement according to claim 1, characterized in that the carrier frame or its parts are made of wood, steel or aluminium.

10. The cooking arrangement according to claim 1, characterized in that a switch element, an illumination element or a display element is integrated into the carrier frame.

11. The cooking arrangement according to claim 1, characterized in that a base body of the carrier frame has at least one groove running in a longitudinal direction of the carrier frame, wherein a sealing element is arranged in the groove for sealing the carrier frame against the worktop.

12. The cooking arrangement according to claim 1, wherein the cooking hob is supported by the carrier frame such that the cooking hob does not directly contact the worktop.

13. The cooking arrangement according to claim 6, wherein the panel is affixed to the base body such that the panel is suspended above the worktop and is not in direct contact with the worktop.

14. The cooking arrangement according to claim 1, wherein the lower portion and the upper portion of the bottom member are integral with each other.

15. The cooking arrangement according to claim 1, wherein the carrier frame directly contacts the top surface of the worktop and is configured such that the entire carrier frame is positioned above the top surface of the worktop.

16. The cooking arrangement according to claim 1, wherein the profiled element has a first bearing area arranged directly on the top surface of the worktop and has a second bearing surface that the top panel member of the cooking hob rests on.

17. The cooking arrangement according to claim 1, wherein the profiled element defines a form fit connection element that receives the spring element within.

18. The cooking arrangement according to claim 1, wherein the spring element is positioned horizontally between the profiled element and the bottom member of the cooking hob.

* * * * *